United States Patent [19]

Coburn

[11] 4,242,934

[45] Jan. 6, 1981

[54] TRIM CHUTE APPARATUS

[75] Inventor: Robert E. Coburn, Warminster, Pa.

[73] Assignee: Molins Machine Company, Inc., Cherry Hill, N.J.

[21] Appl. No.: 10,562

[22] Filed: Feb. 9, 1979

[51] Int. Cl.[3] ..... B26D 7/18

[52] U.S. Cl. ..... 83/100; 83/102; 83/425.2; 83/425.4; 83/479; 83/408

[58] Field of Search ..... 83/100, 425.4, 425.2, 83/425.3; 428, 332, 508, 102, 408, 302, 479

[56] References Cited

U.S. PATENT DOCUMENTS

| | | | |
|---|---|---|---|
| 1,939,925 | 12/1933 | Schwartz | 83/100 |
| 3,135,151 | 6/1964 | Link et al. | 83/100 X |
| 3,156,149 | 11/1964 | Frizelle | 83/100 X |
| 3,465,625 | 9/1969 | Daly | 83/100 |
| 3,759,122 | 9/1973 | Lane et al. | 83/100 X |
| 3,774,491 | 11/1973 | Killilea | 83/428 X |
| 3,795,164 | 3/1974 | Schneider | 83/425.4 X |

*Primary Examiner*—Donald R. Schran

*Attorney, Agent, or Firm*—Seidel, Gonda, Goldhammer & Panitch

[57] ABSTRACT

A frame supports an upper set of trim chutes movable toward and away from each other as well as a lower set of trim chutes movable toward and away from each other. The frame supports an upper web support member and a lower support member thereby defining two web paths. Each trim chute has a portion pivotable to an inoperative position wherein the extent to which each end portion projects in an upstream direction is decreased.

9 Claims, 9 Drawing Figures

TRIM CHUTE APPARATUS

BACKGROUND

As is well known to those skilled in the art, trim chutes are provided in association with a slitter scorer for removing trim cut from the edges of a continuously moving web of corrugated paperboard or the like. The trim chutes convey a trimmed edge portion off opposite sides of the web to an accumulation tank or the like. Recent designs of automatic slitter scorers provide for two or more web paths. As a result thereof, it has been necessary to redesign the structural interrelationships associated with trim chutes.

In conventional slitter scorers, to avoid jamming of web and trim when the leading edge of a new web came from the slitters, it was customary for an operator to be stationed at each side of the machine. Then, when the new web emerged with a trimmed edge on each side, the operators would grasp the trim with one hand and lead it into the trim chute while the other hand guided the main body of the web onto guide tables.

This operation had to be performed at relatively low speed and required two persons. The automatic slitter scorer, on the other hand, changes the web from one path to the other without reducing its speed and the utilization of human operation for guiding such fast moving webs is impractical.

Another problem involved repositioning of the trim chutes. When a web of different width is trimmed, the trim chutes must be repositioned to suit. This has been a time consuming operation because, in most installations, the trim chutes were supported by jury-rigged cables and arms.

SUMMARY OF THE INVENTION

The trim chute apparatus of the present invention includes a frame which is preferably free standing on a floor or the like. First and second upper trim chutes are supported by the frame for reciprocal movement. A motor means is coupled to the upper trim chutes for simultaneously moving said upper trim chutes toward and away from each other to follow the positions of the outer slitter blades.

Third and fourth lower trim chutes are supported by said frame for reciprocal movement. Motor means is coupled to the lower trim chutes for simultaneously moving said lower trim chutes toward and away from each other likewise to follow the positions of the outer slitter blades.

At least one web support member is mounted on said frame below the elevation of said upper trim chutes for supporting a web at an upper web path. At least one web support member is mounted on said frame above the elevation of said lower trim chute for supporting a web at a lower web path. Said support members converge in a downstream direction.

Each trim chute is provided with a web deflector mounted obliquely to the path of the web to guide the leading edge of a web toward its associated web support member. For the upper trim chutes, the web is deflected downward, while lower trim chutes deflect the web upward.

It is an object of the present invention to provide a novel trim chute apparatus which is particularly adapted to be supported by a free standing frame downstream from a slitter scorer and capable of handling a web moving along an upper web path or a lower web path.

It is another object of the present invention to provide a trim chute apparatus having upstream mouth portions which are pivotable to an inoperative position wherein the extent to which each mouth portion projects in an upstream direction may be descreased so as to facilitate movement of the mouth portions out of the way of other equipment associated therewith.

It is a further object of the present invention to provide a trim chute apparatus which can guide the main body of the web into a desired path and guide the trim into chutes for removal without human aid.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown in FIG. 1 a trim chute apparatus in accordance with the present invention designated generally as 10.

Figure 1:
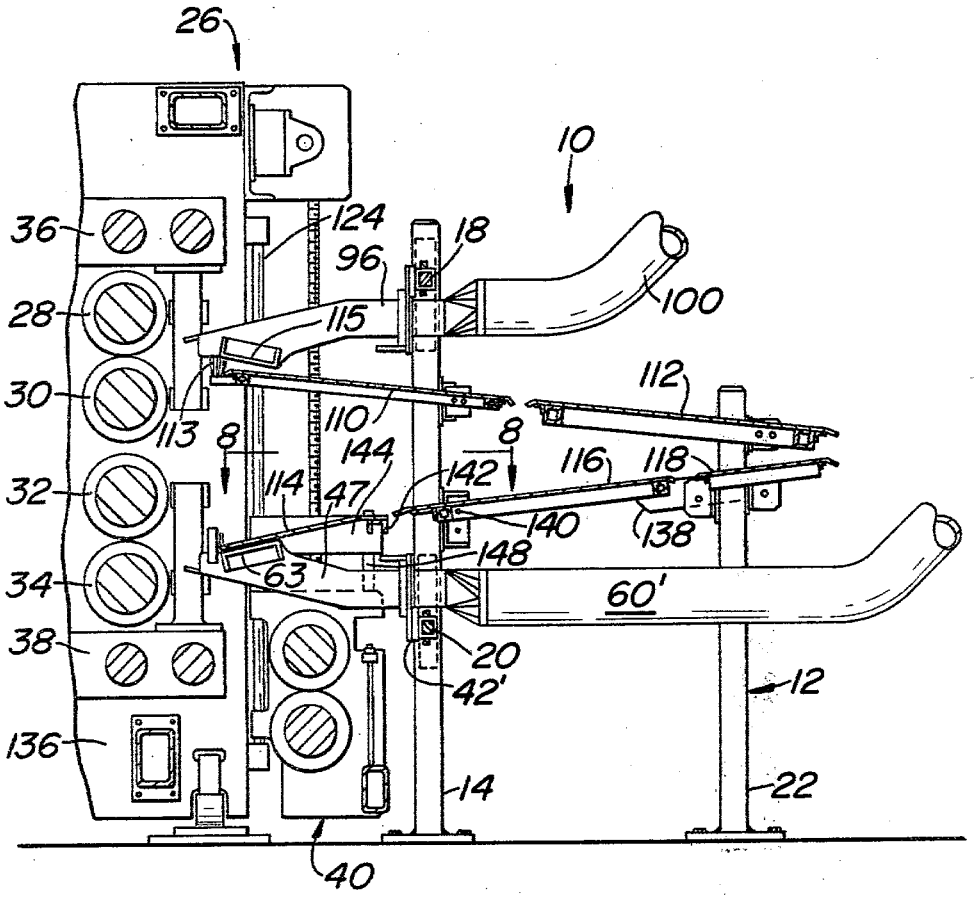
FIG. 1 is a longitudinal sectional view of apparatus in accordance with the present invention.

The apparatus 10 includes a frame designated generally as 12. The frame 12 includes front posts 14 and 16 on opposite sides of the frame and disposed in an upright position. The front posts 14 and 16 are interconnected by an upper rail 18 and a lower rail 20. Each of said rails 18, 20 is horizontally disposed. Frame 12 also includes rear posts 22 and 24 on opposite sides of the frame and downstream from the posts 14, 16. The posts 22, 24 may be interconnected with each other and/or with the posts 14, 16 by one or more rails, not shown.

The apparatus 10 is operatively disposed downstream from a slitter scorer partially shown in FIG. 1 and designated generally as 26. Slitter scorer 26 is preferably of the type disclosed in co-pending application Ser. No. 10,560 filed on Feb. 9, 1979 and entitled Slitter Scorer Apparatus. The slitter scorer 26 includes a mating upper pair of slitter blades 28, 30 and a lower pair of slitter blades 32, 34. Corresponding pairs of blades are provided on each side of the unit. The slitter scorer 26 thus has two web paths, with one web path being defined by the upper pairs of mating blades and one path defined by the lower pairs of mating blades. A blade positioner 36 is reciprocally supported for adjusting the position of the mating blades 28, 30. A similar blade positioner 38 is provided for the lower path and is adapted to adjust the position of the mating lower blades 32, 34. The slitter scorer 26 also is preferably provided with an auxiliary station 40 having slitter blades and/or scorer blades and movable vertically so as to be aligned with the web path associated with the mating blades 32, 34.

Figure 3:
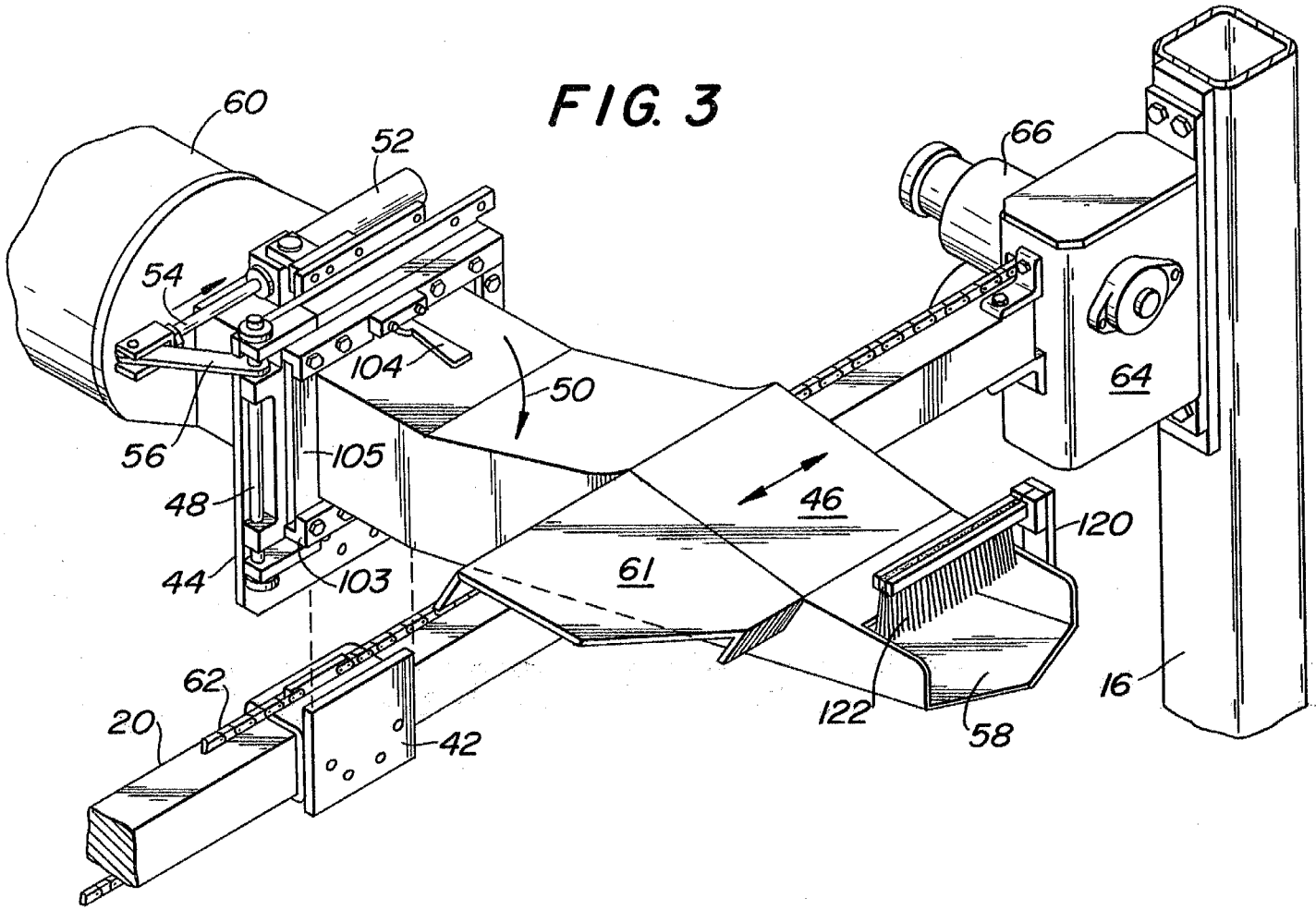
FIG. 3 is a partial perspective view of a lower trim chute.

Referring to FIG. 3, it will be noted that the lower rail 20 supports a carriage 42 for reciprocal movement therealong. A similar carriage 42' is mounted on rail 20 adjacent the opposite end thereof as shown in FIG. 1. Since carriages 42, 42' and the lower trim chutes are identical, only carriage 42 will be described in detail. A support plate 44 is bolted to the front face of carriage 42. The illustration in FIG. 3 is an exploded view. The support plate 44 pivotably supports a trim chute mouth portion 46 for pivotable movement in the direction of arrow 50 about the vertically disposed pin 48.

To effect pivotable movement of the trim chute mouth portion 46, the plate 44 supports a horizontally disposed cylinder 52 having a piston rod 54 extending from one end thereof. The free end of the piston rod 54 is connected to one end of a lever 56. The other end of lever 56 is fixedly secured to said pin 48 on the adjacent end of plate 44. As the piston in cylinder 52 is shifted from one end toward the other, the portion 46 may be pivoted from the operative disposition shown in FIG. 3 to an inoperative disposition (see phantom position in FIG. 2) wherein the extent to which portion 46 extends in an upstream direction has been materially decreased.

The trim chute mouth portion 46 has an inlet opening 58 at one end and is hollow. The other end of portion 46 is in direct communication with a flexible conduit 60 whose cross-sectional area is preferably larger. The opening 58 is the smallest transverse dimension of the trim chute mouth portion 46. Spaced slightly downstream from the opening 58, there is provided an inclined guide plate 61 on the inner vertical surface of the lower trim chute 46 and whose function will be made clear hereinafter. Carriage 42 is connected to discrete ends of the top run of an endless chain 62. The other mating carriage 42' on lower rail 20 is similarly connected to spaced ends of the lower run of said chain 62. Chain 62 extends around a sprocket within housing 64 and is operatively driven by air motor 66 whereby the trim chute mouth portion 46 is caused to move toward and away from its mating trim chute mouth portion 47 on the lower rail 20. Mouth portion 47 is provided with inclined guide plates 63 analogous to guide plate 61. That relationship will be apparent from the following description with respect to trim chutes on the upper rail 18.

Figure 4:
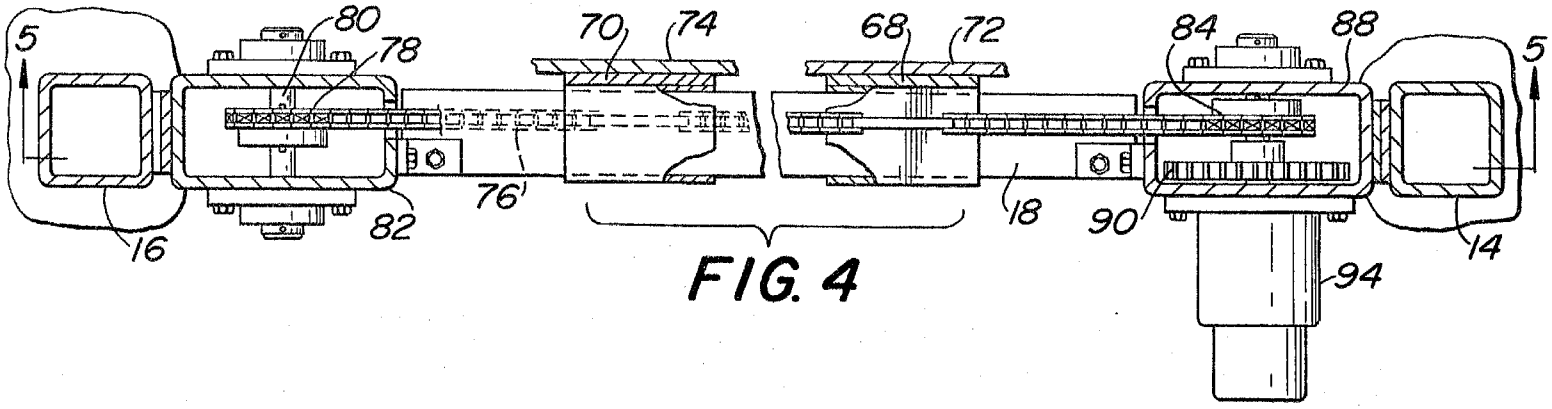
FIG. 4 is a sectional view taken along the line 4—4 in FIG. 1 and showing an upper trim chute assembly.
Figure 5:
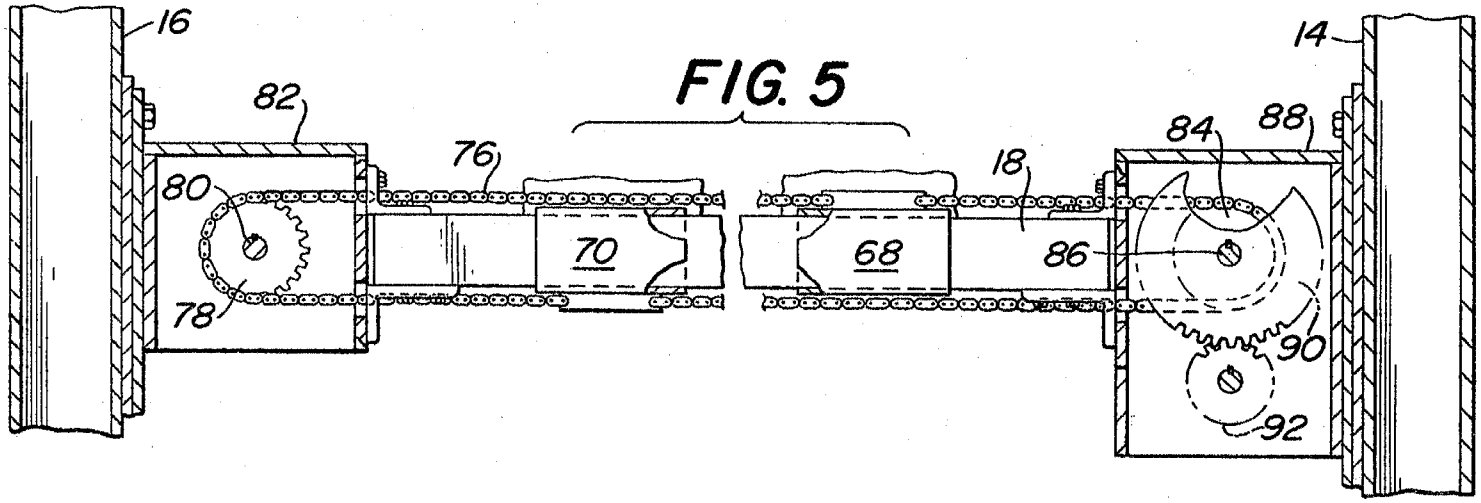
FIG. 5 is a sectional view taken along the line 5—5 in FIG. 4.

Referring to FIGS. 4 and 5, carriages 68 and 70 are supported by the upper rail 18 and guided for reciprocal movement therealong. A support plate 72 is bolted to the carriage 68. A support plate 74 is bolted to the carriage 70. The support plates 72, 74 are similar to support plate 44. Carriage 68 is connected to spaced ends of the upper run of an endless chain 76. Carriage 70 is connected to spaced ends of the lower run of the endless chain 76. See FIG. 5.

The endless chain 76 extends around a sprocket 78 on shaft 80. The shaft 80 is supported by bearings on a housing 82 bolted to the front post 16. The other end of the endless chain 76 extends around a sprocket 84 on shaft 86. Shaft 86 is supported by bearings on a housing 88. Housing 88 is bolted to the front post 14.

A gear 90 is attached to the shaft 86. Gear 90 is meshed with the output gear 92 of a reversible air motor 94. Hence, motor 94 drives the chain 76 whereby the carriages 68 and 70 are simultaneously moved toward and away from one another depending on the direction of rotation of gear 90.

Figure 2:
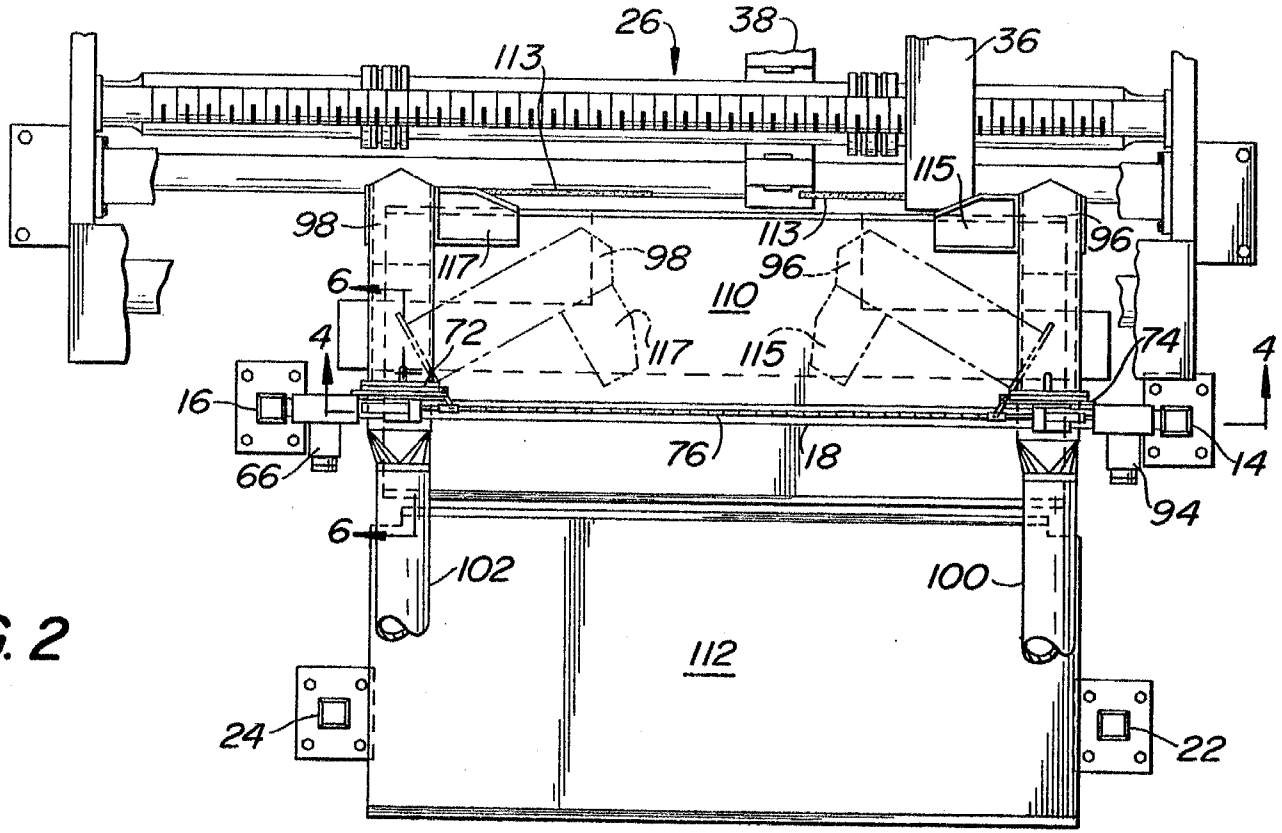
FIG. 2 is a top plan view of the apparatus shown in FIG. 1.

As shown more clearly in FIG. 2, a trim chute mouth portion 96 is supported by the support plate 74. A trim chute mouth portion 98 is supported by the support plate 72. Each of the support plates 72, 74 supports a cylinder such as cylinder 52 for pivoting the trim chute mouth portions 96, 98 inwardly towards each other to the phantom position as shown in FIG. 2. The trim chute mouth portions 46, 47, 96, 98 preferably extend as close as possible to the nip between their associated pairs of mating blades 28, 30 or 32, 34 for the most efficient operation in connection with capturing and removing side edge trim from a web. When the trim chutes have such a disposition, they necessarily are, when in their operative position, in a position to interfere with reciprocatory movement of the blade positioners 36 or 38. Thus, the trim chute mouth portions 46, 47, 96 and 98 have an inoperative retracted position wherein the distance to which they extend upstream is materially decreased. Compare the solid line position and the phantom position for the trim chutes 96, 98 in FIG. 2.

Figure 6:
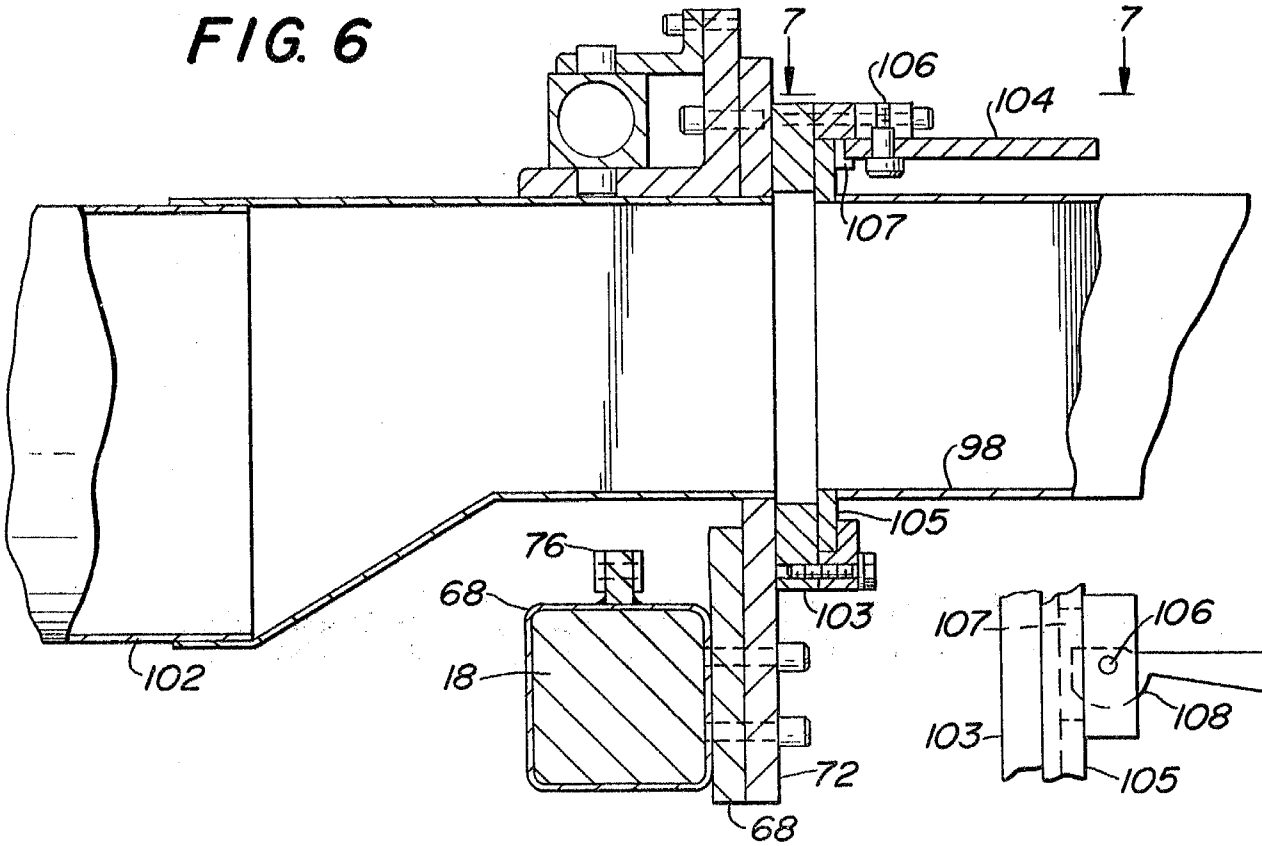
FIG. 6 is a sectional view taken along the line 6—6 in FIG. 2.

An exhaust conduit 100 communicates with the trim chute 96. An exhaust conduit 102 communicates with the trim chute 98. The conduits 100, 102 are preferably flexible conduits having an enlarged cross-section as shown in FIG. 6 and is connected to a source of suction, not shown.

Figure 7:
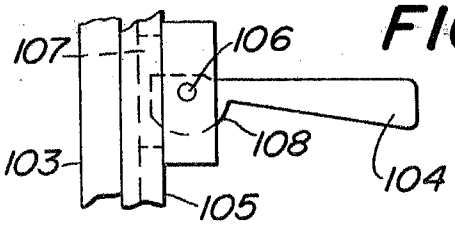
FIG. 7 is a view taken along the line 7—7 in FIG. 6.

A frame 103 is removably bolted to the front face of support plate 72. See FIG. 6. The frame 103 has a U-shaped channel for receiving a flange 105 on the trim chute mouth portion 98. The flange 105 is slid into the U-shaped channel endwise and is releasably retained therein by a handle 104. Handle 104 is pivotable about the pin 106 on frame 103. Handle 104 has a wedge portion 108 which enters a recess 107 on the flange 105. As shown in FIGS. 6 and 7, the handle 104 retains the chute mouth portion 98 in the frame 103. If handle 104 is rotated counterclockwise through an arc of 90° in FIG. 7, portion 108 will be disposed outside of the recess 107 whereby trim chute mouth portion 98 may be rapidly removed and replaced by a similar trim chute mouth portion of different size or shape. When auxiliary station 40 in in an operative position, the trim chute mouth portions are substantially shorter than portions 46, 47 described above and illustrated in the drawings.

A web support member 110 is supported by the front posts 14, 16. As shown in FIG. 2, the upstream corners of member 110 are notched. At the leading edge of member 110, there is provided upwardly projecting bristles 113 which extend across and into the inlet opening on mouth portions 96, 98. The web being processed is fed between bristles 113 and the guide plate 115 on the chute mouth portion 96. Guide plate 115 is generally inclined toward and spaced from the support member 110. See FIG. 1. The rear posts 22, 24 are provided with a web support member 112 aligned with member 110. The members 110, 112 define an upper web path. The trim chute mouth portion 98 similarly cooperates with the bristles 113 and has an inclined guide plate 117 analogous to plate 115. Each of the trim chute mouth portions 46, 47 has a bracket 120 extending upwardly and from which is extending bristles 122 which extend downwardly into the inlet opening 58. See FIG. 3.

Figures 8, 9:
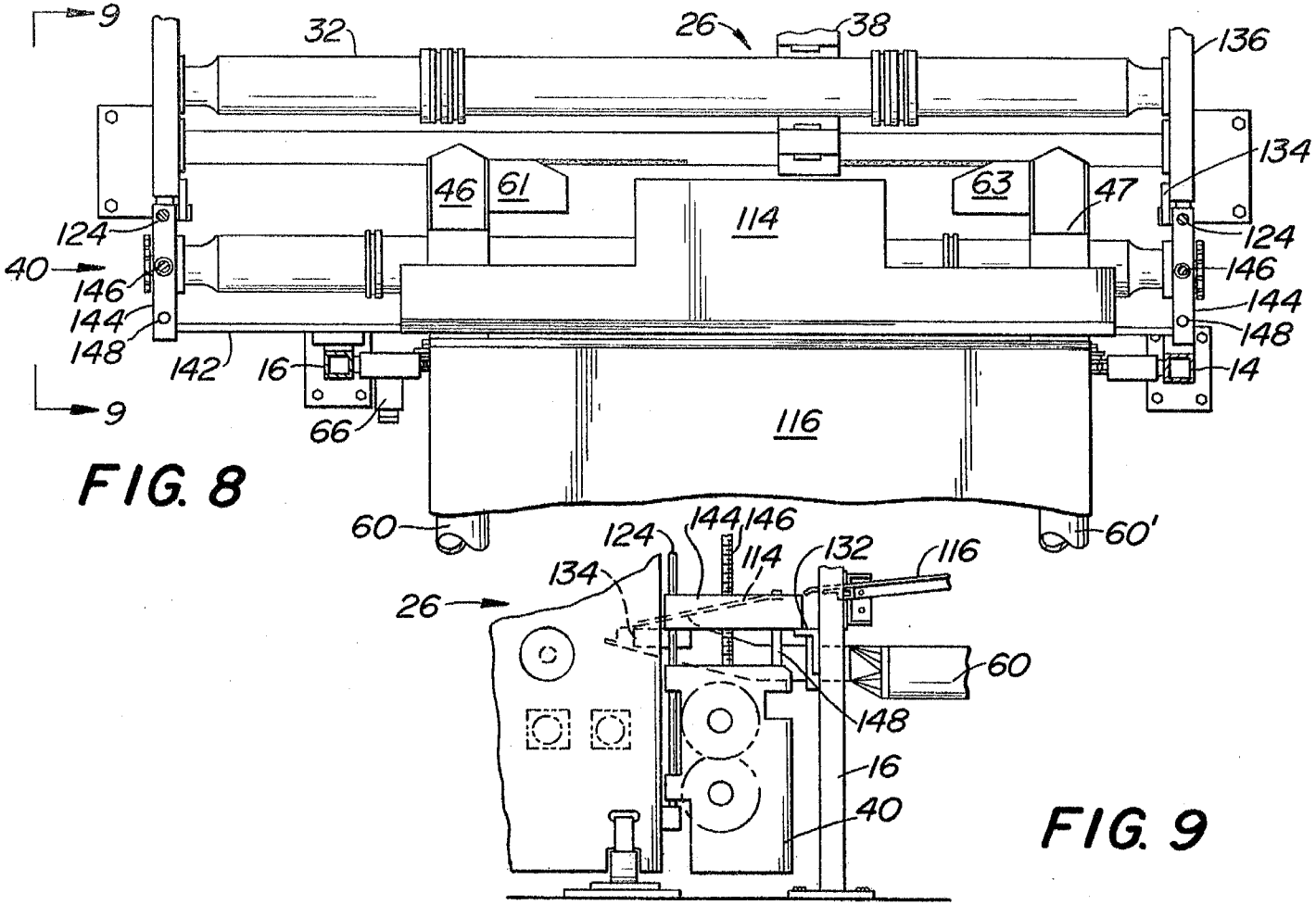
FIG. 8 is a view taken along the lines 8—8 in FIG. 1.
FIG. 9 is a view taken along the lines 9—9 in FIG. 8.

As shown more clearly in FIGS. 1 and 9, a lower web path is defined by discrete web support members 114, 116 and 118. Member 114 is supported at its downstream edge by brackets 132 and at its upstream edge by brackets 134. Brackets 134 are fastened to the slitter scorer side frames 136. Brackets 132 are fastened to each of the front posts 14, 16. See FIGS. 8 and 9. Member 114 is not fastened in position but rather is merely supported from below by said brackets.

Member 116 is supported by the front posts 14 and rear posts 22. The downstream end of member 116 is provided with a pair of hinge brackets 138 pivotally connected to rear post 22. A pin 140, removable from a bracket in front post 14, supports the upstream end of web support member 116. By removing a pin 140 on each side of the frame, member 116 may be pivoted counterclockwise in FIG. 1 to a vertical position parallel to post 22 for service.

Member 114 includes a transverse stiffener 142 which may be made from a structural channel. Connected to each end of the stiffener 142 is a pilot bar 144. The upstream end of each bar 144 rests on said brackets 134 which is fastened to the slitter scorer side frame 136. The downstream end of each bar 144 rests on one of said brackets 132. Member 114 therefore is held in its operative position as shown in FIG. 1 by the effect of gravity.

The left and right side frames of the slitter scorer 26 are each provided with a vertical shaft 124 which is spaced from its frame and secured at each end. Pilot bar 144 is provided with a hole for a sliding fit on the shaft 124. The auxiliary unit 40 is also provided with clearance holes for a sliding fit on the vertical shafts 124. The purpose of the vertical shafts 124 is to guide the vertical movement of the auxiliary station 40 and the pilot bars 144.

Fastened to each end of auxiliary station 40 and extending vertically upward a short distance is pilot shaft 148. The pilot bar 144 is provided with a clearance hole for a slide fit on pilot shaft 148. Each pilot bar 144 is provided with a third clearance hole for the auxiliary station elevating screw 146. It is to be noted that there is no contact between the pilot bar 144 and the elevating screw 146.

Elevating screws 146 are connected to a motor, not shown, in the upper part of slitter scorer 26. Actuation of this motor causes rotation of elevating screws 146 which effects vertical translation of the auxiliary station 40. As the auxiliary station 40 is raised, it comes into contact with web support member 114 and raises it to an inactive position under web support 110 when the auxiliary station 40 is then in an operative position adjoining a web path between blades 32, 34.

Member 118 is pivotally connected to the upstream side of posts 22, 24. A manually removable pin supports member 118 on the downstream side of posts 22, 24. Removal of the pin allows member 118 to pivot in a clockwise direction as shown in FIG. 1 for service.

The frame 12 of the apparatus 10 is a free standing frame positioned adjacent the downstream end of a slitter scorer 26 as shown in FIG. 1. When a web is being processed along the upper web path by blades 28, 30, the web is then directed between the bristles 113 and the guide plates 115, 117 on the trim chute mouth portions 96, 98 respectively and is deflected downward by plates 115, 117. Thereafter, the web is supported by members 110, 112. The bristles 113 help to confine the web and prevent it from flapping out of control. The guide plates 61, 63 on the lower trim chutes portions 46, 47 cooperate with members 114, 116, 118 in a similar manner. However, plates 61, 63 deflect the web upwardly.

The blade positioner 36 repositions the blades 28, 30 for a particular production run. Depending upon the width of the web being slit, the trim chute mouth portions 96, 98 will be moved toward or away from each other so as to properly receive any trim along each edge of the web by means of motor 94. Before the blade positioner 36 moves, the trim chute edge portions 96, 98 are moved to the phantom position shown in FIG. 2 by means of the cylinder and related elements corresponding to elements 52, 54 and 56. Blade positioner 38 is similarly interrelated with trim chute mouth portions 46, 47.

It is to be noted that the web guide plates 61, 63, 115 117 are attached to the sides of their respective mouth portions 46, 47 and 96, 98 oblique to the path of the web emerging from one of the web paths. Preferably, this angle is approximately 15°. Thus, as the web emerges from the slitter blades 28, 30 or 32, 34, gravity will pull it downward. In the case of a web on the upper web path, the guides 115, 117 will deflect the web onto web support member 110. The web emerging on the lower web path will be deflected upward onto web support member 114. On each side, the trim will come under the influence of air being sucked into the mouths of the trim chutes and pulled into the chutes by suction.

The present invention may be embodied in other specific forms without departing from the spirit or essential attributes thereof and, accordingly, reference should be made to the appended claims, rather than to the foregoing specification as indicating the scope of the invention.

I claim:

1. Trim chute apparatus comprising a frame having an upper web path and a lower web path, first and second upper trim chutes supported by said frame for reciprocal movement transverse to said upper web path, first motor means coupled to said upper trim chutes for simultaneously moving the upstream end of said trim chutes toward and away from each other, third and fourth lower trim chutes supported by said frame for reciprocal movement transverse to said lower web path, second motor means coupled to said lower trim chutes for simultaneously moving the upstream end of said lower trim chutes toward and away from each other, at least one web support member mounted on said frame below the elevation of said upper trim chutes for supporting a web in the upper web path, at least one web support member mounted on said frame above the elevation of said lower trim chutes for supporting a web in the lower web path, and each trim chute upstream mouth portion being movable to an inoperative position wherein the extent to which each mouth portion projects in an upstream direction is decreased.

2. Apparatus in accordance with claim 1 wherein each trim chute mouth portion is pivotable about a vertical axis.

3. Apparatus in accordance with claim 1 wherein said web support members converge in a downstream direction.

4. Apparatus in accordance with claim 1 wherein each trim chute has an upstream mouth portion removably supported by its frame for rapid removal so that a trim chute mouth portion of different size may be substituted therefor.

5. Apparatus in accordance with claim 1 wherein each trim chute has an upstream mouth portion mounted for pivotable movement to facilitate decreasing the extent to which each mouth portion projects in an upstream direction, each trim chute mouth portion having a discrete motor associated therewith for causing such pivotable movement.

6. Apparatus in accordance with claim 1 wherein each upper trim chute has a guide plate adjacent its upstream end, each of said guide plates being above the elevation of the upper web support member and generally oblique to the upper web path.

7. Apparatus in accordance with claim 6 including bristles supported adjacent to the upstream end of said trim chutes and projecting into the inlet to said trim chutes.

8. Apparatus in accordance with claim 1 wherein said first and second trim chutes are supported by a horizontally disposed rail which is transverse to said web paths, said first trim chute being connected to the upper run of an endless member on said rail, said second chute being connected to a lower run of said endless member.

9. Apparatus in accordance with claim 1 wherein said chutes remote from said upstream ends are adapted to be coupled to a source of suction for withdrawal of trim through said chutes.

* * * * *